US010830255B2

(12) United States Patent
Bigi et al.

(10) Patent No.: US 10,830,255 B2
(45) Date of Patent: Nov. 10, 2020

(54) CENTRIFUGAL COMPRESSOR WITHOUT EXTERNAL DRAINAGE SYSTEM, MOTORCOMPRESSOR AND METHOD OF AVOIDING EXTERNAL DRAINAGE IN A COMPRESSOR

(71) Applicant: Nuovo Pignone Tecnologie Srl, Florence (IT)

(72) Inventors: Manuele Bigi, Calenzano (IT); Giuseppe Sassanelli, Florence (IT); Duccio Fioravanti, Florence (IT); Massimiliano Ortiz Neri, Pisa (IT); Matteo Dozzini, Torgiano (IT)

(73) Assignee: Nuovo Pignone Tecnologie Srl, Florence (IT)

( * ) Notice: Subject to any disclaimer, the term of this patent is extended or adjusted under 35 U.S.C. 154(b) by 79 days.

(21) Appl. No.: 16/077,342

(22) PCT Filed: Mar. 6, 2017

(86) PCT No.: PCT/EP2017/055135
§ 371 (c)(1),
(2) Date: Aug. 10, 2018

(87) PCT Pub. No.: WO2017/153311
PCT Pub. Date: Sep. 14, 2017

(65) Prior Publication Data

US 2019/0048895 A1 Feb. 14, 2019

(30) Foreign Application Priority Data

Mar. 8, 2016 (IT) ..... 102016000024311

(51) Int. Cl.
*F04D 29/70* (2006.01)
*F04D 31/00* (2006.01)
(Continued)

(52) U.S. Cl.
CPC ..... *F04D 29/706* (2013.01); *F04D 17/10* (2013.01); *F04D 17/125* (2013.01);
(Continued)

(58) Field of Classification Search
None
See application file for complete search history.

(56) References Cited

U.S. PATENT DOCUMENTS 3,777,479 A * 12/1973 Hagen ..... F02C 9/54 60/39.25
4,027,993 A * 6/1977 Wolff ..... F01K 25/04 415/1

(Continued)

FOREIGN PATENT DOCUMENTS

WO 2009/111616 A2 9/2009
WO WO-2009106385 A1 * 9/2009 ..... B01D 45/06
WO WO-2018150534 A1 * 8/2018 ..... F04B 39/00

OTHER PUBLICATIONS

Search Report and Written Opinion issued in connection with corresponding IT Application No. 102016000024311 dated Nov. 22, 2016.

(Continued)

*Primary Examiner* — Michael Lebentritt
(74) *Attorney, Agent, or Firm* — Baker Hughes Patent Org.

(57) ABSTRACT

A compressor has a lower inlet with an intake plenum and an upper outlet with a discharge scroll; the compressor includes a plurality of drainage pipes ending at the intake plenum.

9 Claims, 3 Drawing Sheets

(51) Int. Cl.

| | |
|---|---|
| ***F04D 29/42*** | (2006.01) |
| ***F04D 17/12*** | (2006.01) |
| ***F04D 17/10*** | (2006.01) |

(52) U.S. Cl.
CPC ..... *F04D 29/4206* (2013.01); *F04D 31/00* (2013.01); *F05D 2260/602* (2013.01)

(56) References Cited

U.S. PATENT DOCUMENTS

| | | | | |
|---|---|---|---|---|
| 4,034,428 | A * | 7/1977 | Jacuzzi | A47K 1/14 29/221.6 |
| 4,035,114 | A * | 7/1977 | Sato | F04C 29/026 418/84 |
| 6,171,074 | B1 | 1/2001 | Charron | |
| 6,273,674 | B1 | 8/2001 | Charron | |
| 8,079,805 | B2 * | 12/2011 | Maier | B01D 45/12 415/115 |
| 8,690,519 | B2 * | 4/2014 | Aalburg | F04D 21/00 415/1 |
| 8,845,281 | B2 * | 9/2014 | Cerretelli | F04D 29/023 415/169.2 |
| 8,967,954 | B2 * | 3/2015 | Jonen | B01D 45/06 415/144 |
| 9,909,597 | B2 * | 3/2018 | Dickson | F04D 21/00 |
| 2009/0087298 | A1 * | 4/2009 | Shibata | F04D 29/4206 415/1 |
| 2010/0135769 | A1 | 6/2010 | Kleynhans et al. | |
| 2010/0290896 | A1 | 11/2010 | Lenderink et al. | |
| 2019/0010947 | A1 * | 1/2019 | Mei | F04D 17/12 |
| 2019/0136862 | A1 * | 5/2019 | Landi | F04D 29/0413 |

OTHER PUBLICATIONS

International Search Report and Written Opinion issued in connection with corresponding PCT Application No. PCT/EP2017/055135 dated May 24, 2017.

International Preliminary Report on Patentability issued in connection with corresponding PCT Application No. PCT/EP2017/055135 dated Sep. 11, 2018.

* cited by examiner

CENTRIFUGAL COMPRESSOR WITHOUT EXTERNAL DRAINAGE SYSTEM, MOTORCOMPRESSOR AND METHOD OF AVOIDING EXTERNAL DRAINAGE IN A COMPRESSOR

FIELD OF INVENTION

Embodiments of the subject matter disclosed herein correspond to centrifugal compressors without external drainage system, motorcompressors and methods of avoiding liquid accumulation and external drainage in compressors.

BACKGROUND OF THE INVENTION

There are compressors that are designed to operate with gaseous working fluid but that can tolerate some liquid (e.g. up to 5 m %) in the gaseous working fluid.

It is to be noted that the quantity of liquid typically varies during operation of such compressors; for example, sometimes there may be a lot of liquid (e.g. 5 m %) and sometimes there may be no liquid (i.e. 0 m %).

In such compressors, when the working fluid is wet, some liquid accumulates inside the casing of the compressor during operation. The accumulated liquid must be drained outside the casing. Therefore, such compressors must have an external drainage system, i.e. a system for external drainage.

The external drainage system adds to the complexity, difficulty and cost of such compressors, specifically of the design, manufacture, operation and maintenance of such compressors.

In order to reduce the quantity of liquid in the gaseous working fluid entering such compressors, separators are used. Anyway, separators adds to the complexity, difficulty and cost of the plants including such compressors.

SUMMARY OF INVENTION

Therefore, there is a general need for improving compressors, in particular centrifugal compressors.

This need is higher for centrifugal compressors used in the field of "Oil & Gas" (i.e. machines used in plants for exploration, production, storage, refinement and distribution of oil and/or gas) for compressing gas carrying e.g. some liquid oil and/or some liquid water.

This need is even higher for centrifugal compressors used in the field of "Oil & Gas" for subsea applications.

One important idea behind the embodiments of the subject matter disclosed herein is to avoid that liquid accumulates inside the casing of the compressor during its operation and to make sure that all the liquid entering the compressor through its intake exits the compressor through its discharge. If some liquid is drained inside the compressor during its operation, the drained liquid is entrained by the working fluid of the compressor. The drained liquid may be fed upstream the first stage of the compressor, in particular to the intake plenum of the compressor. The compressor is configured to process the working gas and the liquid drained, so that the liquid exits the compressor through its discharge.

First embodiments of the subject matter disclosed herein relate to centrifugal compressors.

According to such first embodiments, the centrifugal compressor has a vertical axis, a lower inlet with an intake plenum and an upper outlet with a discharge scroll; the centrifugal compressor comprises a plurality of drainage pipes ending at the intake plenum. The intake plenum is arranged in the lower portion of the compressor.

Second embodiments of the subject matter disclosed herein relate to motorcompressors.

According to such second embodiments, the motorcompressor comprises a motor and a centrifugal compressor driven by the motor; the centrifugal compressor has a vertical axis, a lower inlet with an intake plenum and an upper outlet with a discharge scroll; the centrifugal compressor comprises a plurality of drainage pipes ending at the intake plenum.

Third embodiments of the subject matter disclosed herein relate to methods of avoiding accumulation and external drainage of liquid in the working fluid of a compressor.

According to such third embodiments, liquid drained inside the compressor is fed to an intake plenum of the compressor.

BRIEF DESCRIPTION OF THE DRAWINGS

The accompanying drawings, which are incorporated herein and constitute an integral part of the present specification, illustrate exemplary embodiments of the present invention and, together with the detailed description, explain these embodiments. In the drawings.

DETAILED DESCRIPTION

The following description of exemplary embodiments refers to the accompanying drawings.

The following description does not limit embodiments of the invention. Instead, the scope of embodiments of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
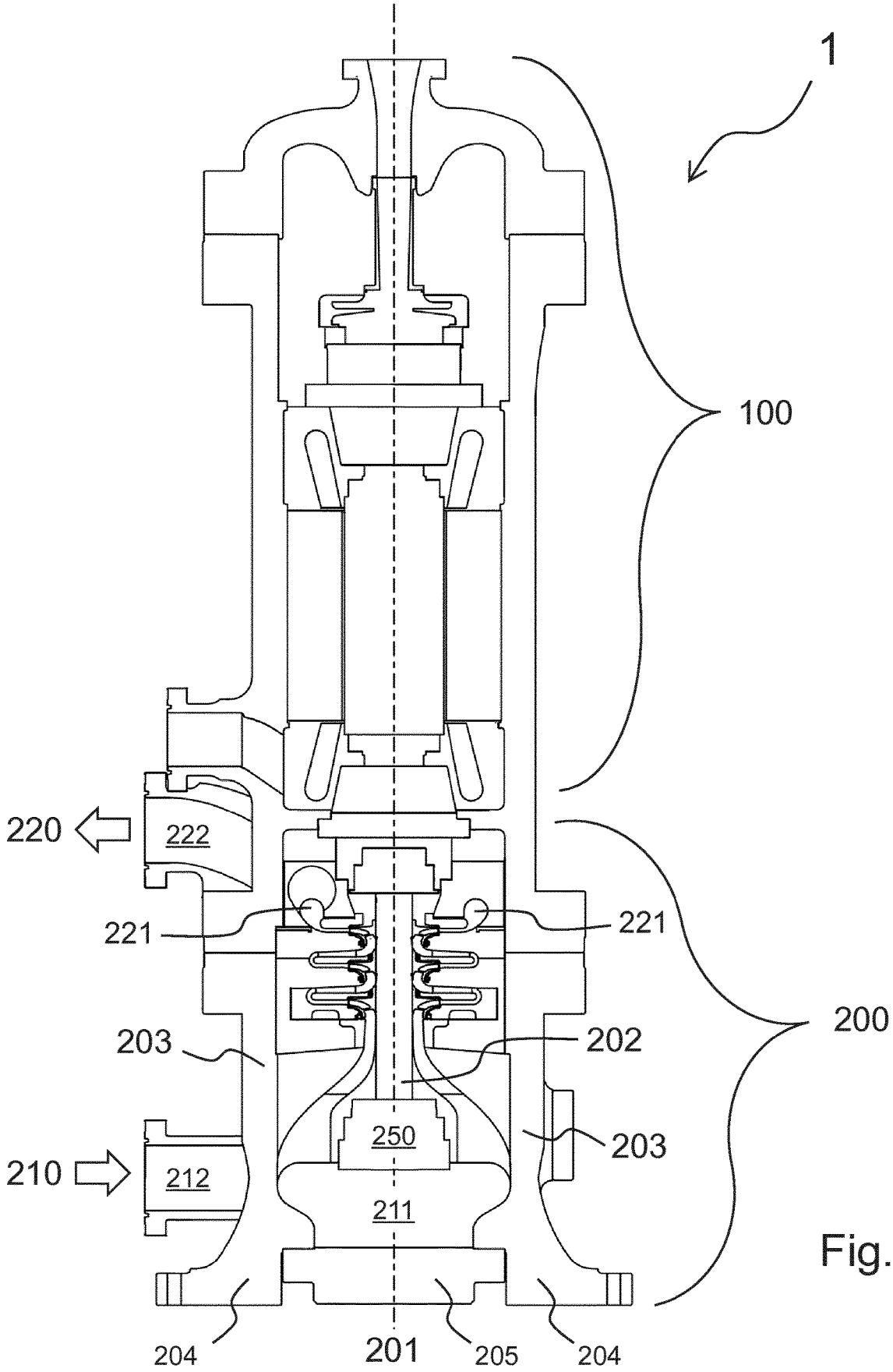
FIG. 1 shows schematically a longitudinal cross-section of an embodiment of a motorcompressor.

FIG. 1 shows a motorcompressor 1 comprising a motor 100 and a centrifugal compressor 200 driven by the motor 100.

The motor 100 is an electric motor and has a vertical axis. The compressor 200 is a centrifugal compressor with multiple compressor stages and has a vertical axis 201. The two vertical axes coincides and the compressor 200 is below the motor 100.

The motorcompressor 1 has a casing split into three casing portions: an upper casing portion (or "cover"), a middle casing portion and a lower casing portion 203. The casing portions are joined by means of flanges.

The lower casing portion 203 comprises a supporting base 204, at its lower end, with a central opening wherein a closing element 205 is fit.

The compressor 200 has a lower inlet 210 with an intake plenum 211 and an inlet pipe 212, protruding radially from the casing (in particular the lower casing portion 203) and fluidly connected to the plenum, and an upper outlet 220 with a discharge scroll 221 and an outlet pipe 222, protruding radially from the casing (in particular the middle casing portion) and fluidly connected to the scroll.

In FIG. 1, another pipe protrudes from the middle casing portion (just above the pipe 222); it is used to discharge the cooling fluid of the motor 100

As can be seen better in FIG. 2, the compressor 200 comprises a plurality of drainage pipes 231 starting from an annular chamber 232, (i.e. a drainage chamber) just below a first stage of the compressor 200, and ending at the intake plenum 211. The liquid drained inside the compressor 200 goes into the drainage chamber 232 and then flows toward the drainage pipes 231; such flow may be facilitated by an inclined bottom wall of the drainage chamber 232 (as in FIG. 2).

The intake plenum 211 comprises an upper convergent portion 211A; the portion 211A may be roughly cone-shaped; the portion 211A may start at a level equal approximately to the top level of the inlet pipe 212 (as in FIG. 2) or above.

Figure 2:
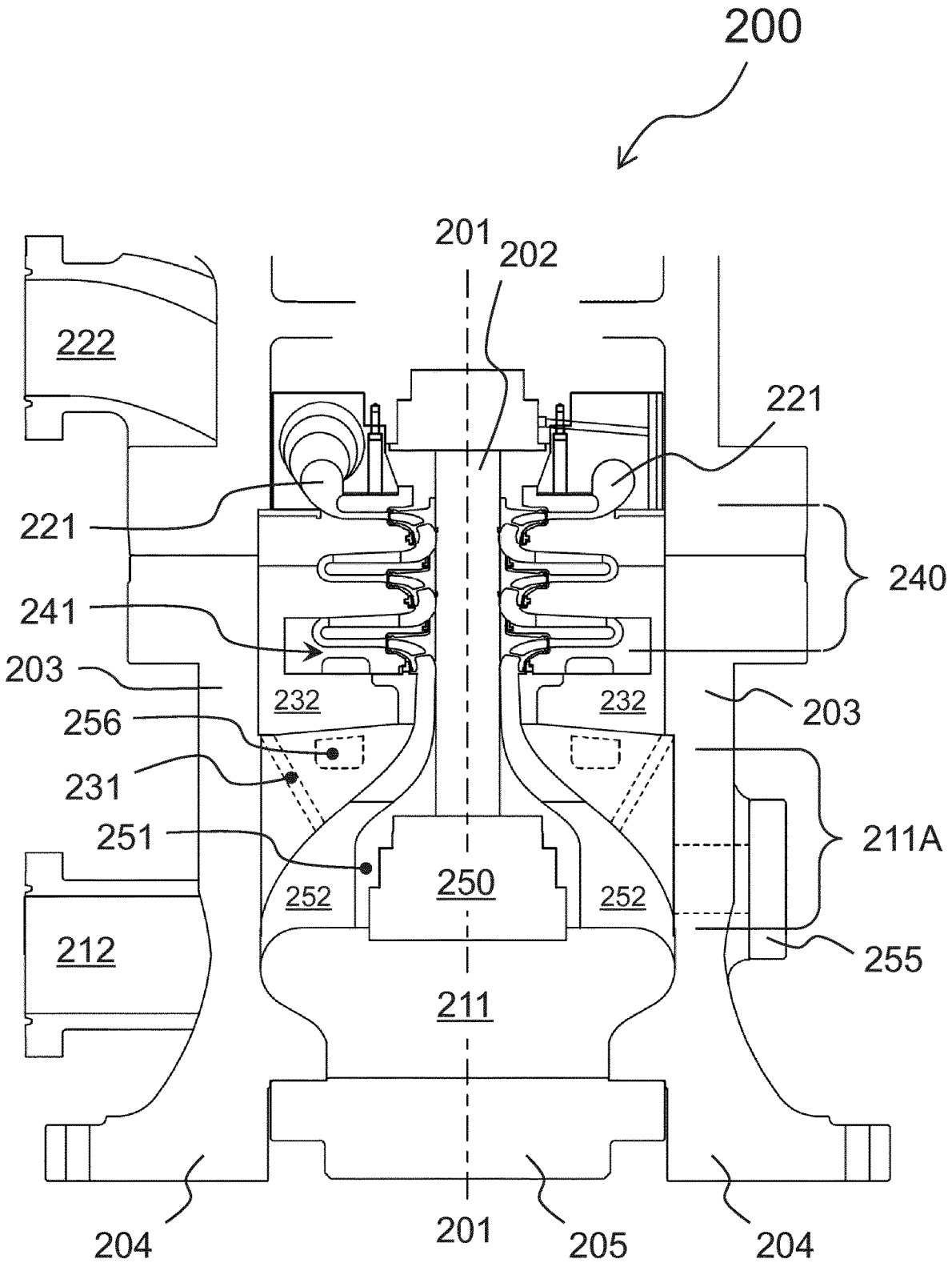
FIG. 2 shows in detail a longitudinal cross-section of an embodiment of a centrifugal compressor.

The drainage pipes 231 end, in an embodiment, at the upper convergent portion 211A of the intake plenum 211 (as in FIG. 2).

At least the end portions of the drainage pipes 231 are, in an embodiment, inclined with respect to the vertical axis 201 and/or skew with respect to the vertical axis 201; in the embodiment of FIG. 2, the whole pipes 231 are inclined. In the portion 211A the working fluid flows from bottom to top; therefore, inclined pipes facilitate entrainment by the working fluid of the liquid exiting the pipes. In the portion 211A the working fluid may swirl around the axis 201; therefore, skew pipes facilitate entrainment by the working fluid of the liquid exiting the pipes.

Along these drainage pipes the condensation can flow down by gravity into the intake plenum. In particular, the condensation occurs when the machine is stopped for a while. During this phase a great amount of liquid can accumulate into the intake plenum.

It is unlikely that liquid accumulates at the bottom of the plenum 211 (i.e. above the closing element 205) as the working fluid flowing into and out of the plenum 211 will entrain it as soon as it exits the drainage pipes 231. In any case, liquid accumulated at the bottom of the plenum 211 may be conveniently removed by the flow of the working fluid into and out of the plenum 211.

The centrifugal compressor 200 comprises a plurality of impellers 240 mounted to a shaft 202 having an axis corresponding to the axis 201 of the compressor.

In an embodiment, at least a first impeller 241, i.e. the impeller that is first encountered by the fluid flow, is resistant to liquid droplets. A suitable resistant impeller is disclosed e.g. in international patent application WO2015036497A1. Being at least the first impeller 241 resistant to the liquid erosion, the compressor can process both gas and liquid. In this way, the liquid drained in the intake plenum can be processed by means of the compressor itself and ejected outside through the compressor discharge. This feature allows to avoid the use of a scrubber or separator upstream the inlet of the compressor 200.

The rotor, in particular the shaft 202, of the compressor 200 is guided and supported by bearing devices.

In the embodiment of FIG. 2, there is a bearing device 250 located in the intake plenum 211, in particular in its upper convergent portion 211A. The bearing device 250 is a radial bearing and guides the shaft 202 of the compressor 200. Alternatively, a bearing device located in the intake plenum may be an axial bearing and may support the shaft of the compressor. Alternatively, a bearing device located in the intake plenum may be used for both guiding and supporting the shaft of the compressor. It is to be noted that in the embodiment of FIG. 2, the inlet pipe of the compressor is radial and the intake of the compressor is at least partially outside of the bearing span of the compressor; in fact, the bearing device 250 is located in the intake plenum 211.

Figure 3:
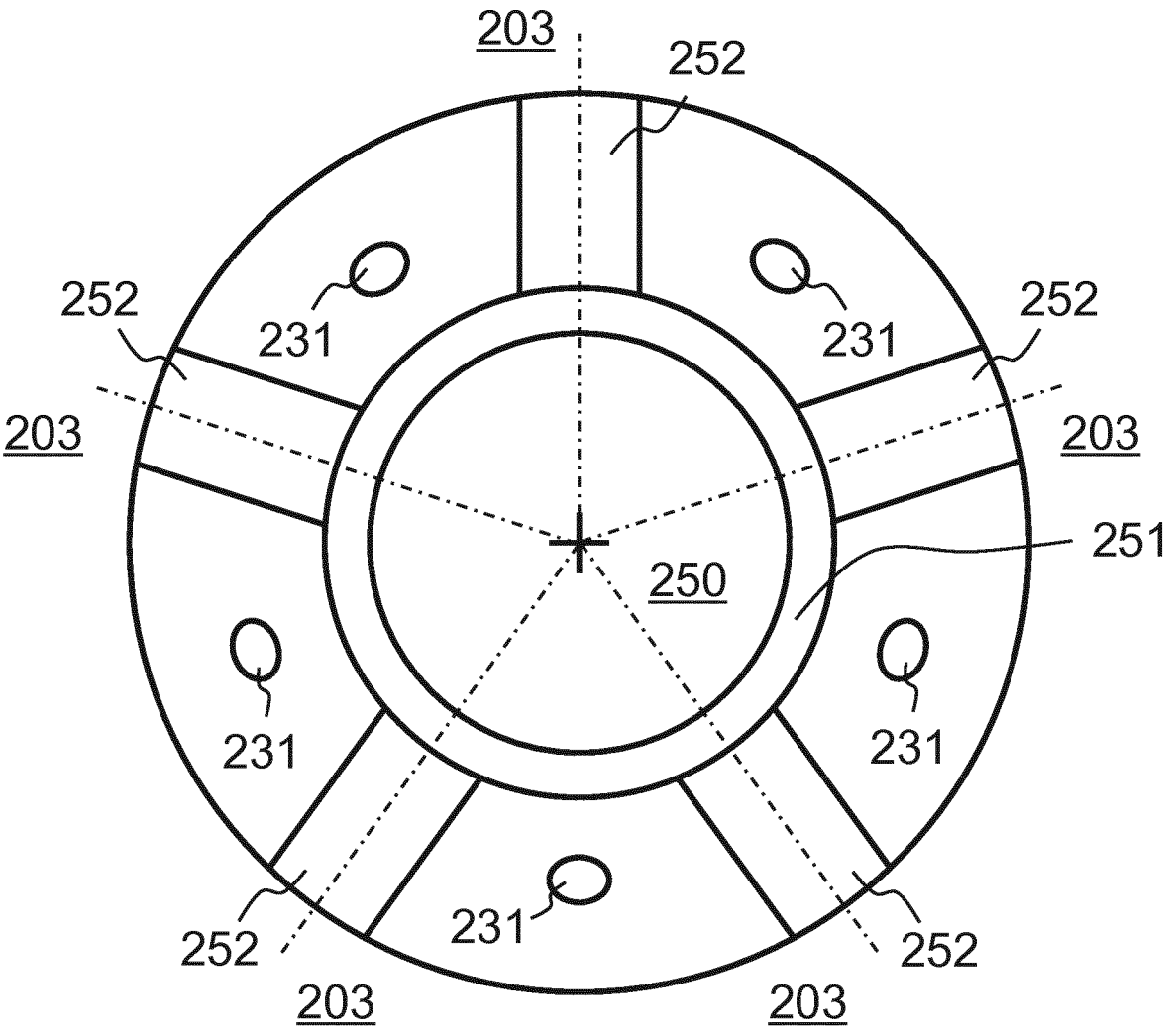
FIG. 3 is a bottom view of the intake plenum of the compressor of FIG. 2.
Figure 4:
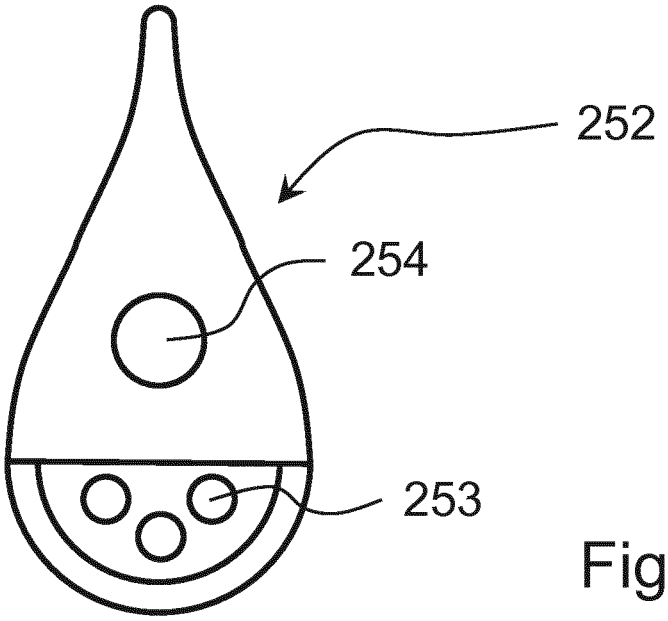
FIG. 4 is a cross-section view of a possible strut in the compressor of FIG. 2.

The bearing device 250 has a housing 251 that is fixed to the casing of the compressor, specifically to the lower casing portion 203, through a plurality of struts 252 (see FIG. 2 and FIG. 3 and FIG. 4). The struts 252 may have aerodynamic portions, i.e. portions having a cross-section with low fluid-flow resistance and/or fluid guidance (see FIG. 4). The struts 252 define flow channels inbetween. In the embodiment of FIG. 2, the drainage pipes 231 end in the flow channels defined by the struts 252; alternatively, the drainage pipes may end at a level above the struts, i.e. downstream the struts.

Details relating to the bearing device 250 may be seen in FIG. 3 and FIG. 4.

The struts 252 are radially oriented; in the embodiment of FIG. 3, they are even, in particular five.

The bearing device 250 is cooled by the flow of the working fluid of the compressor. A cooling system may also be provided that feeds a cooling fluid to the bearing device 250 as well as to other bearing devices of the compressor 200.

Electric wires and/or flow pipes may be associated to the struts. The wires may be control and/or power supply electric wires. The pipes may be cooling fluid pipes. A single strut may be associated to one or more wires and/or to one or more pipes.

In the embodiment of FIG. 4, for example, a single strut comprises a solid portion, wherein a pipe 254 is drilled, and a shell covering three sets of wires 253.

As can be seen in FIG. 2, the compressor 200 (in particular its lower casing portion 203) has a flange (whereto a closing element 255 is fixed) designed for electrical connection of power and control of the bearing device 250.

As can be seen in FIG. 2, the compressor 200 has an annular cavity 256 designed for electrical distribution of power and control of the bearing device 250.

It is to be noted that, alternatively to FIG. 4, the electric wires for the bearing device 250 be positioned, for example, inside a cylindrical shell located below the bearing device 250. Referring to FIG. 2, such cylindrical shell may extend from the closing element 205 to the bottom of the bearing device 250; in this case, the electric wires pass through the closing element 205.

The embodiment of the figures implements a method of avoiding accumulation and external drainage of liquid in the working fluid of a compressor, in particular a vertical centrifugal compressor.

According to such method, the liquid drained inside the compressor is fed to an intake plenum of the compressor; in particular, the plenum is located at a lower end of the compressor. In this way, all the liquid entering the compressor through its intake exits the compressor through its discharge.

In an embodiment, according to such method, the drained liquid is fed to a region of the intake plenum where the magnitude and/or the direction of the speed of the working fluid is/are such as to entrain the fed drained liquid. In this way, it is avoided (or at least limited) that the fed drained liquid falls on the bottom of the compressor casing after exiting the drainage pipes. In any case, liquid accumulated at the bottom of the plenum may be conveniently removed by the flow of the working fluid into and out of the plenum.

It is to be noted that, at different operating conditions (for example, at rest, during transients, at partial speed, at full speed, at over speed), the flow from the drainage pipes varies and to flow from the inlet pipe varies; thus the entrainment phenomenon also varies.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A centrifugal compressor comprising:

a vertical axis;

a lower inlet with an intake plenum comprising an upper convergent portion;

an upper outlet with a discharge scroll; and a plurality of drainage pipes ending at the upper convergent portion of the intake plenum, wherein the compressor is configured to process the drained liquid accumulated in the intake plenum.

2. The centrifugal compressor of claim 1, wherein at least the end portions of the drainage pipes are inclined with respect to the vertical axis and/or skew with respect to the vertical axis.

3. The centrifugal compressor of claim 1, wherein the centrifugal compressor comprises a plurality of impellers, wherein at least the first impeller is resistant to liquid droplets.

4. A centrifugal compressor comprising:

a shaft;

a vertical axis;

a lower inlet with an intake plenum;

an upper outlet with a discharge scroll;

a plurality of drainage pipes ending at the intake plenum; and a bearing device located in an upper convergent portion of the intake plenum to guide and/or support the shaft, wherein the compressor is configured to process the drained liquid accumulated in the intake plenum.

5. The centrifugal compressor of claim 4, wherein the centrifugal compressor has a casing, wherein the bearing device has a housing, and wherein the housing is connected to the casing through a plurality of struts.

6. The centrifugal compressor of claim 5, wherein electric wires and/or pipes are associated to the struts.

7. The centrifugal compressor of claim 4, wherein a cylindrical shell is located below the bearing device and covers electric wires.

8. A motorcompressor comprising the centrifugal compressor of claim 1 and a motor to drive the centrifugal compressor.

9. The centrifugal compressor of claim 1, wherein liquid drained inside the compressor is fed to a region of the intake plenum where the magnitude and/or the direction of the speed of the working fluid is/are such to entrain the fed drained liquid.

* * * * *